US008487723B2

(12) United States Patent
Schneider et al.

(10) Patent No.: US 8,487,723 B2
(45) Date of Patent: Jul. 16, 2013

(54) CONTACT ASSEMBLY FOR A RELAY AND RELAY WITH CONTACT ASSEMBLY

(75) Inventors: Axel Schneider, Berlin (DE); Thomas Haehnel, Berlin (DE); Christian Maranke, Luechfeld (DE); Joerg Schultheiss, Nuthetal (DE); Albert Koetter, Berlin (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 13/060,899

(22) PCT Filed: Aug. 14, 2009

(86) PCT No.: PCT/EP2009/060546

§ 371 (c)(1),
(2), (4) Date: Feb. 25, 2011

(87) PCT Pub. No.: WO2010/023116

PCT Pub. Date: Mar. 4, 2010

(65) Prior Publication Data

US 2011/0156848 A1 Jun. 30, 2011

(30) Foreign Application Priority Data

Aug. 26, 2008 (DE) ..... 10 2008 039 705

(51) Int. Cl.
*H01H 1/00* (2006.01)
*H01H 51/22* (2006.01)

(52) U.S. Cl.
USPC ..... 335/196; 335/78; 335/128

(58) Field of Classification Search
USPC ..... 335/78–86, 128, 196–198
See application file for complete search history.

(56) References Cited

U.S. PATENT DOCUMENTS

| | | | | |
|---|---|---|---|---|
| 2,146,577 | A | 2/1939 | Hermann | |
| 2,157,843 | A | 5/1939 | Armstrong et al. | |
| 3,134,871 | A * | 5/1964 | Norden | 335/37 |
| 4,339,642 | A * | 7/1982 | Seymour et al. | 200/558 |

(Continued)

FOREIGN PATENT DOCUMENTS

| | | |
|---|---|---|
| DE | 44 04 442 A1 | 8/1995 |
| DE | 197 42 392 A1 | 4/1999 |
| FR | 1 252 745 A | 2/1961 |
| GB | 725 853 A | 3/1955 |

OTHER PUBLICATIONS

International Search Report issued by the European Patent Office for PCT/EP2009/060546 on Oct. 29, 2009.

*Primary Examiner* — Bernard Rojas
(74) *Attorney, Agent, or Firm* — Faegre Baker Daniels LLP

(57) ABSTRACT

The present invention relates to a contact assembly for a relay for switching high load currents having at least one switch contact and a braid having at least one braid end, which are electrically conductively connected to each other by a connection element. Further, the invention relates to a relay for switching high load currents with a contact assembly. Finally, the invention relates to a method for mounting a relay for switching high load currents. For the simple, electrically conductive connection of the braid and the switch contact without the contact assembly produced requiring much space within the relay, it is provided in accordance with the invention that the connection element is equipped with a contact portion directly connected to the switch contact and with a connection strap connected to the braid end, wherein the connection strap is inclined relative to the contact portion.

5 Claims, 4 Drawing Sheets

U.S. PATENT DOCUMENTS

| | | | | |
|---|---|---|---|---|
| 4,647,743 | A | 3/1987 | Kern et al. | |
| 4,924,197 | A * | 5/1990 | Siepmann | 335/128 |
| 5,049,845 | A | 9/1991 | Yokoyama et al. | |
| 5,369,235 | A | 11/1994 | Hendel | |
| 5,534,834 | A * | 7/1996 | Hendel | 335/78 |
| 5,808,533 | A | 9/1998 | Buescher et al. | |
| 6,861,930 | B2 * | 3/2005 | Simms et al. | 335/14 |
| 7,423,504 | B2 * | 9/2008 | Kon et al. | 335/133 |

* cited by examiner

CONTACT ASSEMBLY FOR A RELAY AND RELAY WITH CONTACT ASSEMBLY

The present invention relates to a contact assembly for a relay for switching high load currents, having at least one switch contact, at least one electrically conductive connection element equipped with a contact portion directly electrically conductively connected to the switch contact, and having a flexible, electrically conductive braid, which is conductively connected to a connection strap of the connection element facing away from the contact portion. Further, the invention relates to a relay for switching high load currents. In addition, the invention relates to a method for mounting a relay for switching high load currents, wherein a braid is electrically conductively connected to a switch contact that can be deflected in one switching direction to form a contact assembly.

Contact assemblies for relays for switching high load currents and relays for switching high load currents with the above-mentioned contact assembly are widely encountered. In general, the relay is equipped with an actuator, which converts control signals into movements. The actuator may take the form of a coil, which generates a magnetic field as a function of electrical control signals, which magnetic field can act on an armature of the relay with either attraction or repulsion. The armature, thereby moved by means of control signals, is connected to a switch contact so as to transmit movement, and can move the switch contact in one switching direction at least from a first position to a second position. In the first position or the second position, the switch contact may be conductively contacted to a fixed contact. In the case of many relays, the switch contact remains in a rest position in the first or second position if no appropriate control signal is present at the actuator. For example, the rest position of the switch contact is predefined by an armature spring which is installed, pre-stressed, in the relay and retains the switch contact in the first or second position when no control signal is present. If, however, the appropriate control signals are present at the actuator, the switch contact is moved into the respective other position in opposition to the active spring force of the armature spring. Without appropriate control signals, the switch contact will again return to the starting position under the spring force.

Especially when high load currents, for example, of over 30 A are to be switched, cables with a large cross-section are required to conduct the high load current from the fixed contact to the switch contact. Used in modern relays as the cable between a fixed terminal of the relay and the switch contact are "braids", i.e. braiding comprising a plurality of thin strands. These braids are flexible and thereby do not significantly impede the movement of the switch contact relative to the fixed terminal.

In general, the ends of the braids are fastened directly to the switch contact and the fixed terminal. In this case, the braid ends may, for example, be welded to the contacts. However, a direct connection of braid end and welded contact is not easy to establish since the welded contact is frequently also connected to an armature spring, meaning there is little space available for a conductive fixed connection between the braid end and welded contact.

To simplify the connection of switch contact and braid end, the switch contact may be enlarged, as shown, for example, in U.S. Pat. No. 4,647,743. Since, however, the switch contacts produced are, in particular, made of high-grade materials which, even after several thousand switching cycles, are virtually free from signs of wear, the solution with large switch contacts shown in this publication is costly.

In U.S. Pat. No. 4,339,642, the switch contact is conductively connected to the braid via a contact carrier. The contact carrier may be made of a less high-grade material than the switch contact since it is not directly involved in the switching processes and only has to conduct the load currents from the switch contact to the braid. In this publication, the braid is welded to a tab, which is aligned essentially parallel relative to the switching surface of the switch contact. The tab is connected via a conductive clearance element to a contact portion which is fastened to the switch contact and runs parallel relative to the switching surface. The tab is configured to have clearance from the switch contact, making it readily accessible for connecting tools. The switch contact carrier is retained by a capturing means through which the flexible braid is guided.

The disadvantage of this embodiment is that the contact carrier is relatively large by comparison with the switch contact. Especially when the contact carrier is mounted on the capturing means, an assembly is obtained that cannot readily be installed in compact relays.

It is therefore an object of the present invention to provide a contact assembly for a relay, a relay with a contact assembly and a method of mounting a relay in which the braid end is conductively combined simply and economically with the switch contact to form a contact assembly, and the contact assembly can be used in compactly designed relays.

For the above-mentioned contact assembly, the object is achieved in accordance with the invention in that the connection strap is inclined relative to the contact portion. For the above-mentioned relay, the object is achieved by the use of a contact assembly in accordance with the invention. For the above-mentioned method, the object is achieved in accordance with the invention in that, in the switching direction, the braid is connected, at least partially, to the switch contact at an inclination relative to a contact portion of a connection element conductively connected directly to the switch contact.

Owing to the configuration of the connection element with the contact portion and with a connection strap, the braid end and the switch contact can be conductively connected to the connection element in succession and with clearance between them. Especially if the contact portion is only slightly larger in comparison with the switch contact, and the connection strap too is not significantly larger than the braid end, the contact assembly requires only little space within the relay. Also, if the switch contact and the braid end are disposed on a common lateral surface of the connection element, both the braid end and the switch contact may be easily fastened to the connection element. If the braid end is fastened so as to bear on the connection strap, and if the braid end and the braid continuing from the braid end at least portionwise run essentially parallel to a longitudinal direction of the connection strap, the angle of inclination by which the connection strap is inclined relative to the contact portion can be selected such that the operating position of the braid is defined by the longitudinal position of the connection strap. Any deformation of the braid is thus ruled out.

The solution in accordance with the invention can be further improved by means of various embodiments, each advantageous per se, which can be freely combined as desired. These embodiments and the advantages associated therewith are described below.

In accordance with a first embodiment, the connection strap and the contact portion may directly graduate into one another in a bent transition region of the connection element. Thus, the connection element may, for example, be produced as a single entity from sheet metal. The connection element may, for example, be stamped from the sheet metal in a simple and economical manner. The transition region of the connection element can then be bent so that the connection strap and the contact portion are configured at an angle of inclination relative to one another. The transition region may comprise a bend edge resulting from the configuration of the connection strap, which is inclined relative to the contact portion.

With this embodiment, the connection strap and the contact portion are connected together via the transition region in a mechanically stable manner and with good electrical conductivity. No separate connection of the contact portion and the connection strap, for example by means of a weld seam, is necessary.

The braid may be connected to the connection strap with clearance from a contact plane running through the switch contact and extending perpendicularly relative to the contact portion. The contact plane may essentially run perpendicularly relative to a longitudinal direction of the connection element and, in particular, to a longitudinal direction of the contact portion. The braid end is thus connected to the connection element with clearance from the switch contact in the longitudinal direction, and does not overlap the switch contact in the switching direction running perpendicularly relative to the longitudinal direction of the contact portion. It is possible for the switch contact to extend through the contact portion and for the switch contact to be equipped with two contact surfaces, which may be disposed on either side of the contact portion. The switch contact may, in an especially simple embodiment, be riveted to the contact portion as a contact rivet, wherein at least the head of the switch contact, which takes the form of a full rivet, or alternatively the pin end of the full rivet opposing the head may be produced from a material suitable for switch contacts. The contact assembly, thus simply executed, may be used as a change-over contact in a relay.

The contact assembly may contain an armature pivotally mounted about a switching axis and an armature spring forming an angle, which may be configured with a bearing arm and a switching arm, which switching arm is disposed between the armature and the contact portion and runs parallel with the armature, wherein the armature, bearing against an internal side of the switching arm, the switching arm and the contact portion may be connected together, wherein the connection strap, inclined away from the armature, may run essentially in the direction of the switching axis.

In particular, the contact portion and the switching arm may be riveted together in a single working step via the switch contact taking the form of a rivet. Since no further connecting means are required for the secure connection of the switching arm, contact portion and switch contact, the contact assembly may be of compact design in the region of the switch contact even if the switch contact takes the form of a change-over contact.

The armature may herein be connected via the switching arm to the contact portion so as to transmit movement, and thus be retained in the contact assembly. Fastening locations via which the armature may be secured to the switching arm may be disposed with clearance from the free end of the switching arm of the armature spring that is tightly connected to the contact portion.

The armature and the connection element can thereby be separately fastened to the armature spring without impairing the fastening process of the other component. In addition, the free end of the switching arm, in the form of an overtravel spring, may be flexibly deflectable relative to the armature, so that the switch contact can be accommodated with spring action by the contact assembly. This additional spring deflection capacity of the switch contact may, for example, reduce the rebound of the switch contact. The free ends of the switching arm, in the form of overtravel springs, enable an automatic adjustment of the switch contacts if the distance measured in the switching direction between the switch contacts and the fixed contacts of the relay is to increase in operation, for example owing to burn-up of the contacts.

The mounting of this contact assembly may easily be accomplished outside the relay since the armature, the armature spring and the switch contact can each be rigidly connected to the connection element and, for example, welded or riveted, without further components of the relay impeding this.

The contact portion may be fastened, bearing on the armature spring, at one of the free ends of the switching arm that form the overtravel springs, wherein the free end of the switching arm may face away from the bearing arm. The bearing arm and the switching arm may graduate into one another in an arc-shaped, spring-energy-transmitting, bend portion of the armature spring. The bend portion and the switching axis may run essentially in parallel with one another, and the switching axis may be located in the region of the bend portion. Owing to the curved shape of the bend portion, the bearing arm and the switching arm may extend essentially perpendicularly relative to one another and be connected together with spring-energy transmission through the bend or connection region.

The armature may be connected, in a fastening region of the switching arm disposed in the region of the bend portion, so as to bear against the switching arm and, for example, may be welded or riveted to the switching arm. The armature may herein extend as far as the bearing arm and where possible, partially enclose the bearing arm in an opening essentially in a non-contacting manner. In the region of the bend portion of the armature spring, the armature may be equipped with two retaining grooves, which are open in directions running parallel with the switching axis.

If the switching arm is deflected in the switching direction relative to the bearing arm, the armature may be pivoted about the switching axis running in the region of the bend portion. The switching axis may herein be disposed in the region of the retaining grooves and run essentially perpendicularly relative to the switching direction and to the longitudinal direction of the contact portion.

Based on the alignment of the connection strap relative to the contact portion, the centre of gravity of the contact assembly may be shifted from the contact plane in the direction of the switching axis, resulting in the shock resistance of the contact assembly being favourably influenced in the event of mechanical shock loading.

The connection strap may essentially face away from the free end of the switching arm, and may, in the switching direction, be inclined away from the switching arm by an angle which, when added to the angle of inclination, may produce an angle of 180°.

The connection strap may be aligned obliquely relative to the switching arm of the armature spring, and the braid may be fastened to a lateral surface of the connection strap that faces away from the switching arm of the armature spring. Consequently, the braid may also be positioned obliquely relative to the switching arm in the direction of its operating position. Particularly if the contact assembly is constructed with two switch contacts, which may be disposed on one common or on two separate contact springs, the two connection elements that are connected to the switch contacts may be equipped with connection straps, which may be disposed to face away from the free ends of the contact arms and from one another. The bend edges of two connection elements that affect the alignment of the connection strap may have a mirror symmetrical characteristic and/or, in particular, a characteristic of mutual alignment, running parallel with one of the straight lines connecting the two switch contacts.

The braid may be fastened at each of its two ends respectively to one of the connection straps, and may assume a looped or curved configuration based on the direction of the connection straps. On the basis of the configuration, the dimensional stability of the braid as a self-supporting structure can be maintained.

Alternatively, one connection element may also be connected to the two ends of the braid and, to this end, assume in particular a Y shape with two connection straps.

The braid ends may, at least portionwise, take the form of rigid elements and be fastened to the particular connection strap via the rigid elements. Even in a terminal region disposed between the braid ends, in particular centrally, the braid may, at least portionwise, take the form of a rigid element, which is positioned in the operating position by the alignment of the connection strap. The rigid elements may essentially be straight in shape and configured for connection with the above-mentioned components, and may be produced, for example, by compression moulding.

The connection strap may exhibit an inclination relative to the contact portion such that the terminal region of the braid, or the rigid bodies, is disposed at a fixed terminal when the contact assembly is accepted by the relay. In particular, the relay may exhibit a stop, on which the bearing arm may bear with spring deflection. The stop may be part of a yoke for the actuator, for example a coil, and be equipped with retaining lugs, which may be introduced into the retaining grooves of the armature in order to mount the contact assembly in the relay. The retaining lugs may restrict any movement of the contact assembly perpendicularly relative to the switching direction, and enable the pivoting of the armature about the switching axis and secure it against relative movements in other directions.

Once the contact assembly has been positioned in the relay via the retaining grooves, the switch contacts can also be functionally aligned relative to fixed contacts supplied by the relay, and where possible bear on the fixed contacts, or be capable of locating on the fixed contacts by deflection of the armature.

Owing to the fact that the braid end is fastened to the connection element with clearance from the contact plane, force influences acting on the switch contact and brought about by the braid, especially in the switching direction, can be reduced.

When mounting the contact assembly and in particular before the contact assembly is installed in the relay, the switch contact can be conductively connected to the contact portion of the connection element that is aligned perpendicularly relative to the switching direction, and the braid can be conductively connected to a connection strap of the connection element that is inclined relative to the contact portion. If the inclination of the connection strap relative to the contact portion corresponds to the inclination of the braid in the switching direction, the connection strap can, at least portionwise, be continued by the braid. A self-supporting, easy to operate contact assembly, which predefines a mounting and operating position of the braid, can thereby be obtained.

In addition, the contact assembly can be supplemented by the armature spring, which retains the switch contact in a predefined position, by fastening the contact portion, disposed between the free end of the armature spring, or overtravel spring, and the switch contact, to the overtravel spring, and aligning the connection strap to face away from the free end.

Furthermore, the contact assembly can be supplemented by the armature, by disposing the armature spring, at least portionwise, between the armature and the contact portion of the connection element, and fastening the armature so as to bear on the armature spring, with clearance from the free end of the armature spring.

Once the contact assembly is positioned in the relay, the inclination of the braid predefines a mounting position of the braid, and the braid can, without additional retaining or positioning means, be connected to a fixed terminal of the relay. The contact assembly, positioned in the relay, can be connected with energy transmissibility to the actuator of the relay so that, using control signals present at the actuator, the at least one switch contact can be deflectable either in or counter to the switching direction.

The invention is explained below with reference to the drawings, by way of examples of different embodiments. The individual features of the embodiments may be combined independently, as described above for the individual advantageous configurations.

The drawings show the following:

Figure 1:
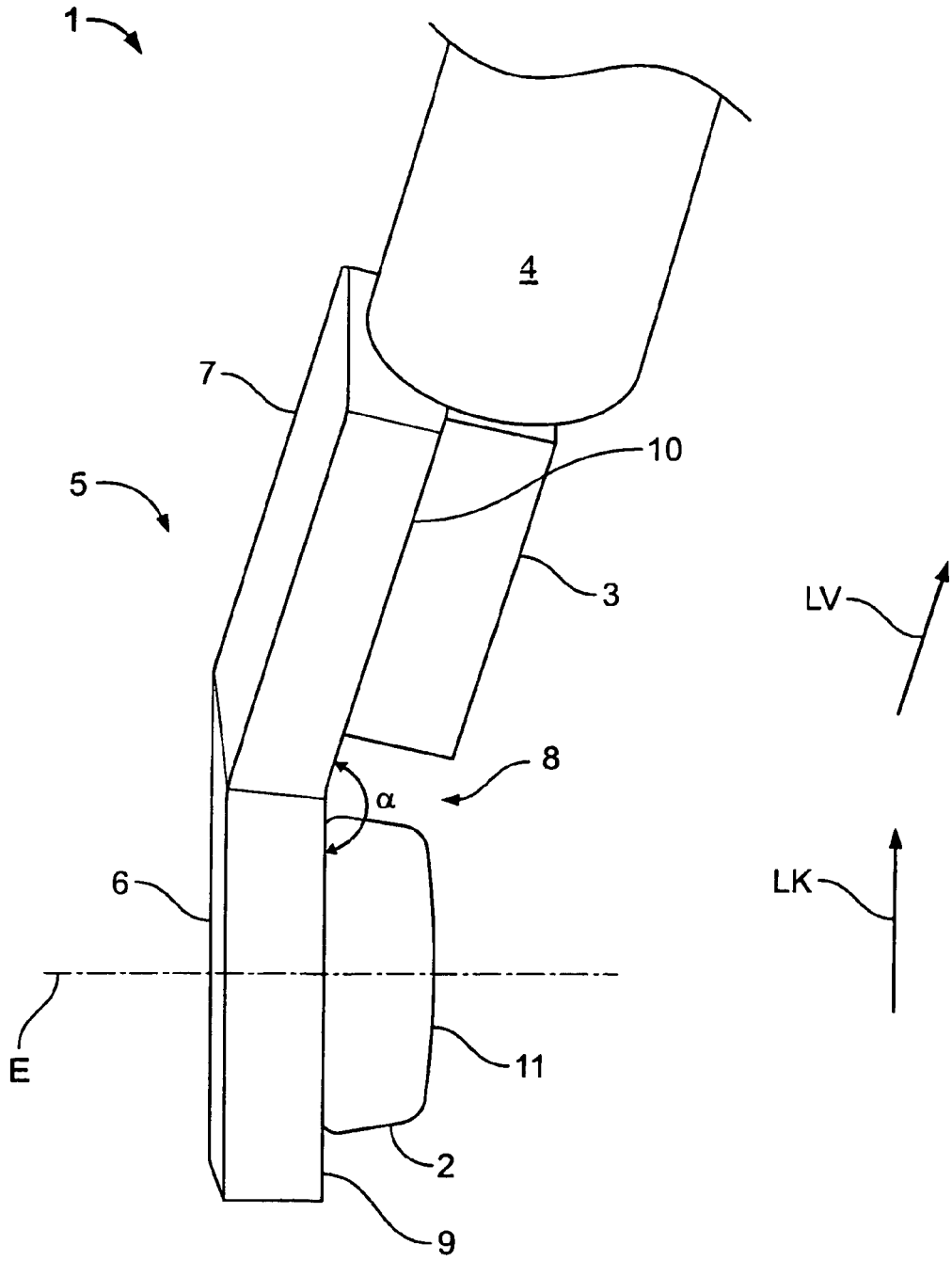
FIG. 1 is a schematic view of a first embodiment of the contact assembly in accordance with the invention.

Firstly, the structure and function of a contact assembly in accordance with the invention will be described with reference to the embodiment from FIG. 1. This shows schematically the contact assembly 1 in accordance with the invention for a relay for switching high load currents, having a switch contact 2 and an end 3 of a braid 4, wherein the switch contact 2 and the braid end 3 are shown conductively connected together by means of a connection element 5.

The connection element 5 is shown in an embodiment with a contact portion 6 and a connection strap 7, which graduate directly into one another in a bent transition region 8. The contact portion 6 and the connection strap 7 are essentially cuboidal in shape. The contact portion 6 extends away from the bent transition region 8 along a longitudinal direction LK, and the connection strap 7 extends along a longitudinal direction LV, wherein the longitudinal directions LK, LV are inclined relative to one another at an angle of inclination $\alpha$. In addition, the longitudinal direction LV of the connection strap 7 faces out of the plane of projection. The transition region 8 exhibits a bend edge C, which runs essentially transversely relative to the longitudinal direction LK or LV.

A contact surface 9 running along the longitudinal direction LK of the contact portion 6 and a connection surface 10 aligned along the longitudinal direction LV of the connection strap 7 coincide in the transition region 8 at an angle of inclination $\alpha$. The switch contact 2 is shown disposed essentially centrally on the contact surface 9, wherein the switch contact 2 is conductively fastened to the contact surface 9. The switch contact 2 may, for example, be welded to the contact surface 9. Alternatively, the switch contact 2 may take the form of a contact rivet and, in particular, of a full rivet, which may be guided through an aperture through the contact portion 6 perpendicular to the longitudinal direction LK of the contact portion 6 and parallel to the plane of projection, and riveted to the contact portion 6. In this case, at least the head of the contact rivet may take the form of the switch contact 2. Likewise running in perpendicular alignment to the longitudinal direction LK of the contact portion 6 is a contact plane E, which intersects the switch contact 2 essentially centrally. The braid 4 is shown connected to the connection surface 10 of the connection strap 7 with a clearance from the contact plane E. The switch contact 2 is equipped with a switching surface 11 running essentially parallel to and with a clearance from the contact surface 9, which switching surface faces away from the contact surface 9 and runs essentially perpendicularly relative to the contact plane E.

The braid end 3 is shown tightly connected to the connection surface 10 of the connection strap 7, and runs essentially parallel to the longitudinal direction LV of the connection strap 7. The braid 4, adjoining the braid end 3 in the longitudinal direction LV of the connection strap 7, continues from the braid end 3 at least portionwise in a straight line.

The braid end 3 may be directly connected to the connection surface 10, and takes the form of a rigid element.

Figure 2:
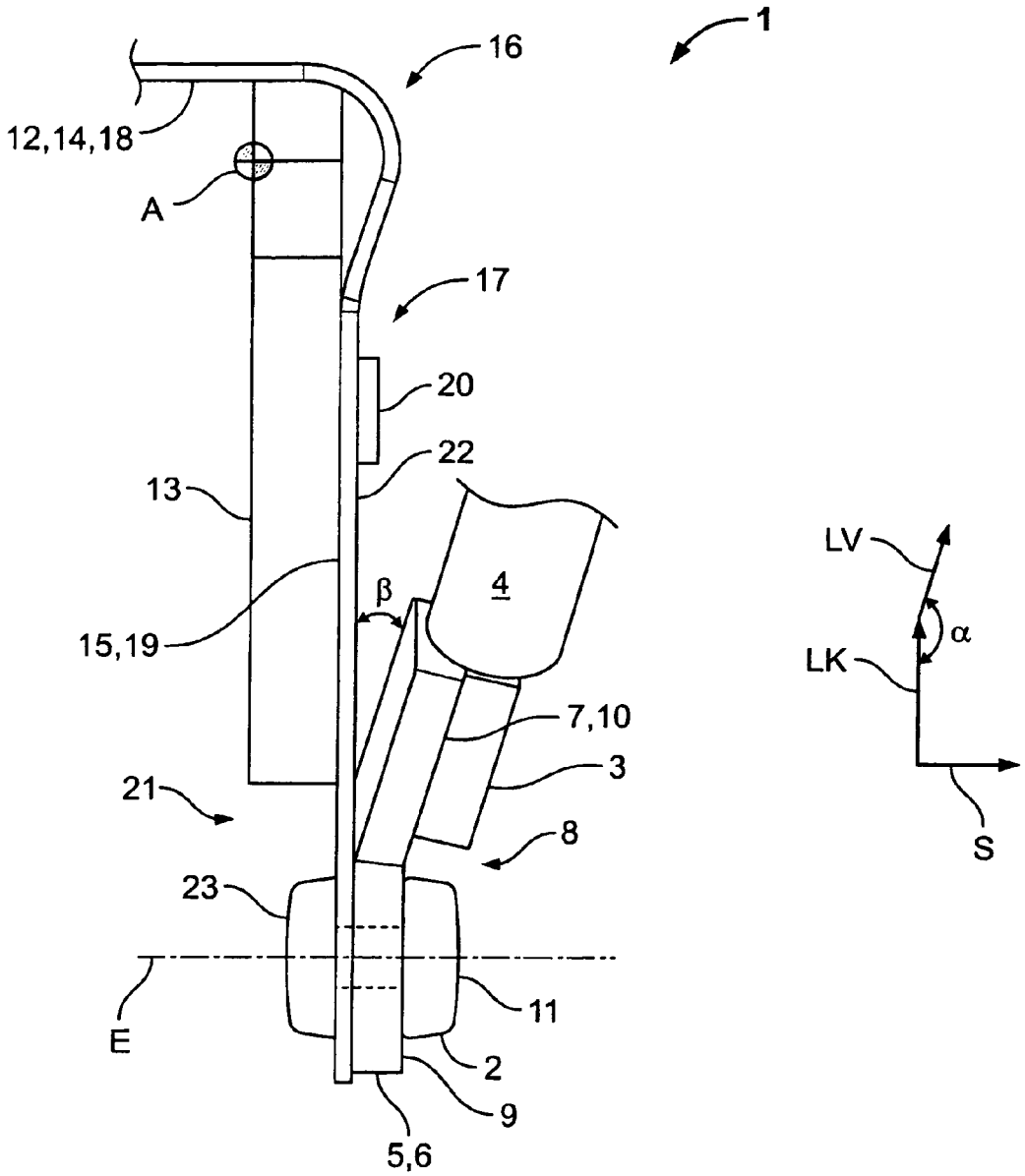
FIG. 2 is a schematic view of a further embodiment of the invention, which differs from the embodiment shown in FIG. 1 in respect of an armature and an armature spring.

FIG. 2 shows a further embodiment, wherein identical reference numerals are used for components that correspond in operation and structure to those in the embodiment shown in FIG. 1. For the sake of brevity, only the differences from the embodiment in FIG. 1 will be discussed.

Additions shown to the contact assembly 1 from FIG. 1 are an armature spring 12 and an armature 13. The armature spring 12 forms an angle under which a bearing arm 14 and a switching arm 15 of the armature spring 12 run towards each other. The bearing arm 14 and the switching arm 15 graduate into one another in a curved bend portion 16. The bend portion 16 continues from a fastening region 17 of the switching arm 15 that runs towards the bearing arm 14, wherein the characteristic of the bend portion 16 initially extends essentially facing away from the bearing arm 14 and then, in its further progression, curves towards the bearing arm 14 and meets the bearing arm 14 in alignment. Internal surfaces 18, 19 of the bearing arm 14 and the switching arm 15 span the angle of the armature spring 12, which equals approximately 90°.

In the side view shown here, the armature 13 is shown as an oblong, which bears on the internal side 19 of the switching arm 15 and extends as far as the bearing arm 14. In the fastening region 17 of the switching arm 15, which fastening region is located between the contact assembly 1 and the bend portion 16, the armature 13 is shown fastened to the armature spring 12. The armature 13 may, for example, be welded to the armature spring 12 or, as shown here, riveted with one or more armature rivets 20. If the switching arm 15 is deflected in a switching direction S, essentially facing perpendicularly away from an external side 21 of the switching arm 15, the armature 13 follows this movement and is pivoted about a switching axis A located in the region of the bend portion 16 and running parallel with the bend portion 16. The switching axis A runs perpendicularly relative to the plane of projection; the switching direction S runs essentially parallel with the contact plane E.

In the region of a free end 22 of the switching arm 15 that faces away from the bend portion 16, the connection element 5 is permanently connected to the armature spring 12, bearing on the external side 21 of the switching arm 15. The contact portion 6 of the connection element 5 is riveted to the switching arm 15 via the switch contact 2 in the form of a contact rivet. The switching surface 11 of the contact rivet 2 faces in the switching direction S. The part of the contact rivet 2 disposed on the internal side 19 of the switching arm 15 is equipped with a further switching surface 23, which faces away from the switching direction S. To accommodate the contact rivet 2, the contact portion 6 of the connection element 5 and the free end 21 of the switching arm 15, which takes the form of an overtravel spring, are equipped with mutually aligned apertures running in the switching direction S.

The connection strap 7 faces essentially away from the free end 21 of the switching arm 15 in the direction of the bend portion 16 of the armature spring 12 and is inclined by an angle β from the external side 22 of the switching arm 15 in the switching direction S. Again in this embodiment, the longitudinal direction LV of the connection strap 7 faces, at least partially, out of the plane of projection. Here too, the braid 4 that continues from the braid end 3 runs parallel with the longitudinal direction LV of the connection strap 7, essentially at an angle β to the external side 22 of the switching arm 15.

Figure 3:
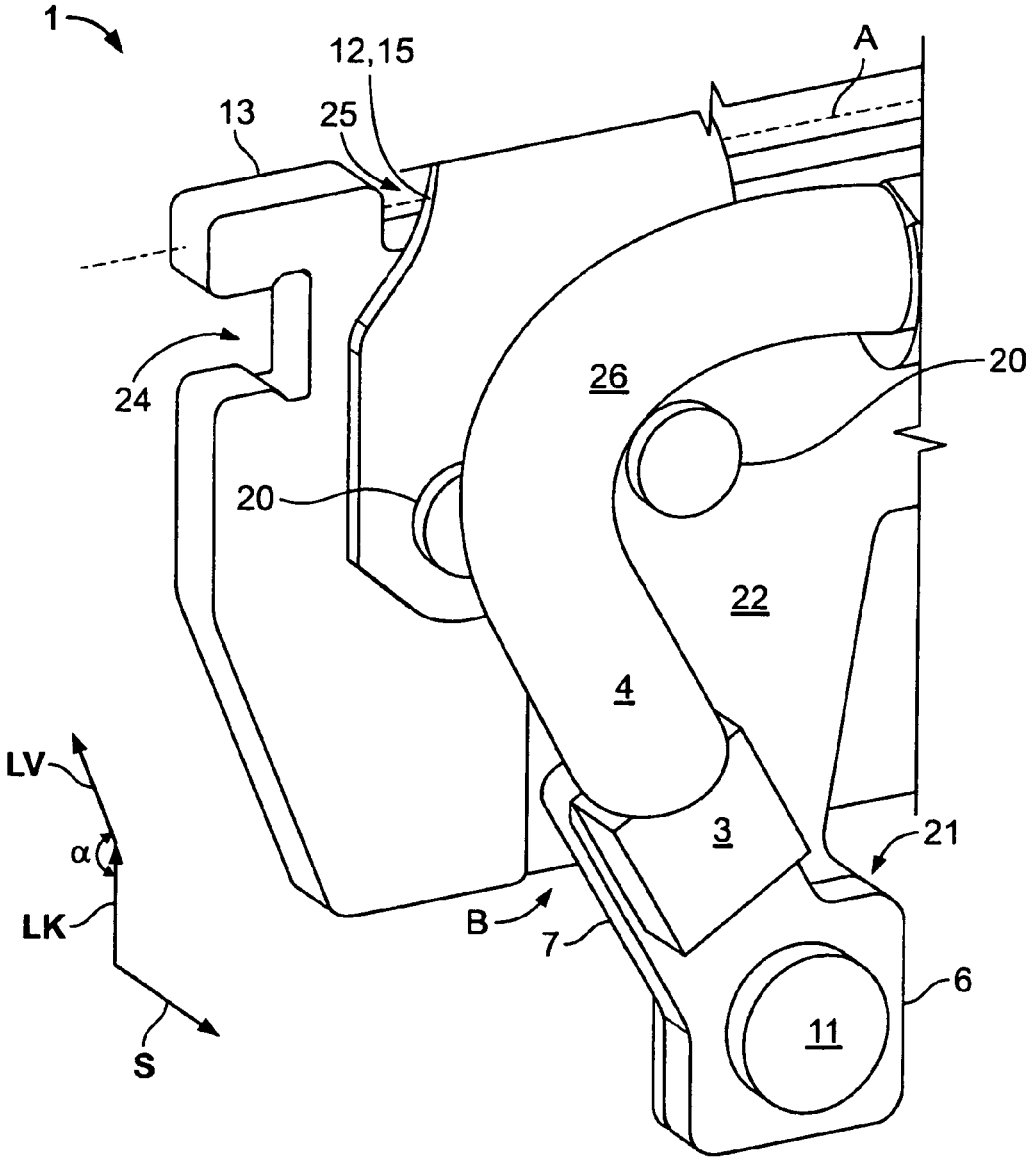
FIG. 3 is a perspective view of the embodiment from FIG. 2.

FIG. 3 shows the embodiment from FIG. 2 in a perspective view, wherein identical reference numerals are used for components that correspond in operation and structure to those in the embodiments shown in FIG. 1 or FIG. 2. For the sake of brevity, only the differences from the embodiments in FIG. 1 and FIG. 2 will be discussed.

In this perspective view of the contact assembly 1, the armature 13 is shown equipped with a retaining groove 24, wherein the retaining groove 24 is open on a side which is perpendicular to the longitudinal direction LK running in the plane of projection and which faces the switching direction S. Along the switching axis A and facing away from the open end of the retaining groove 24, the armature 13 is shaped with an opening 25, which encloses the armature spring 12 at least in the region of the bend portion 16 in a U-shape in a non-contacting manner. The end of the armature 13 opposing the opening 25 and facing away from the longitudinal direction LK of the contact portion 6 is equipped with an indent B, which enables a deflection of the free end 21 of the overtravel spring of the switching arm 15 counter to the switching direction S without the switching arm 15 or components of the contact assembly 1 directly connected thereto colliding with the armature 13 in the case of an operationally required deflection counter to the switching direction S.

The braid 4, continuing from the braid end 3 essentially in a straight line in the longitudinal direction LV of the connection strap 7, is curved in its further progression to form a braid arc 26. The braid arc 26 is shown curved away from the open side of the retaining groove 24 and, at the end of the braid arc 26, runs essentially parallel with the switching axis A.

Here again, the connection strap 7 is inclined, relative to the contact portion 6, by an angle of inclination α out of the plane of projection, and extends essentially diagonally relative to the contact portion 6, which is here shown in rectangular form.

Figure 4:
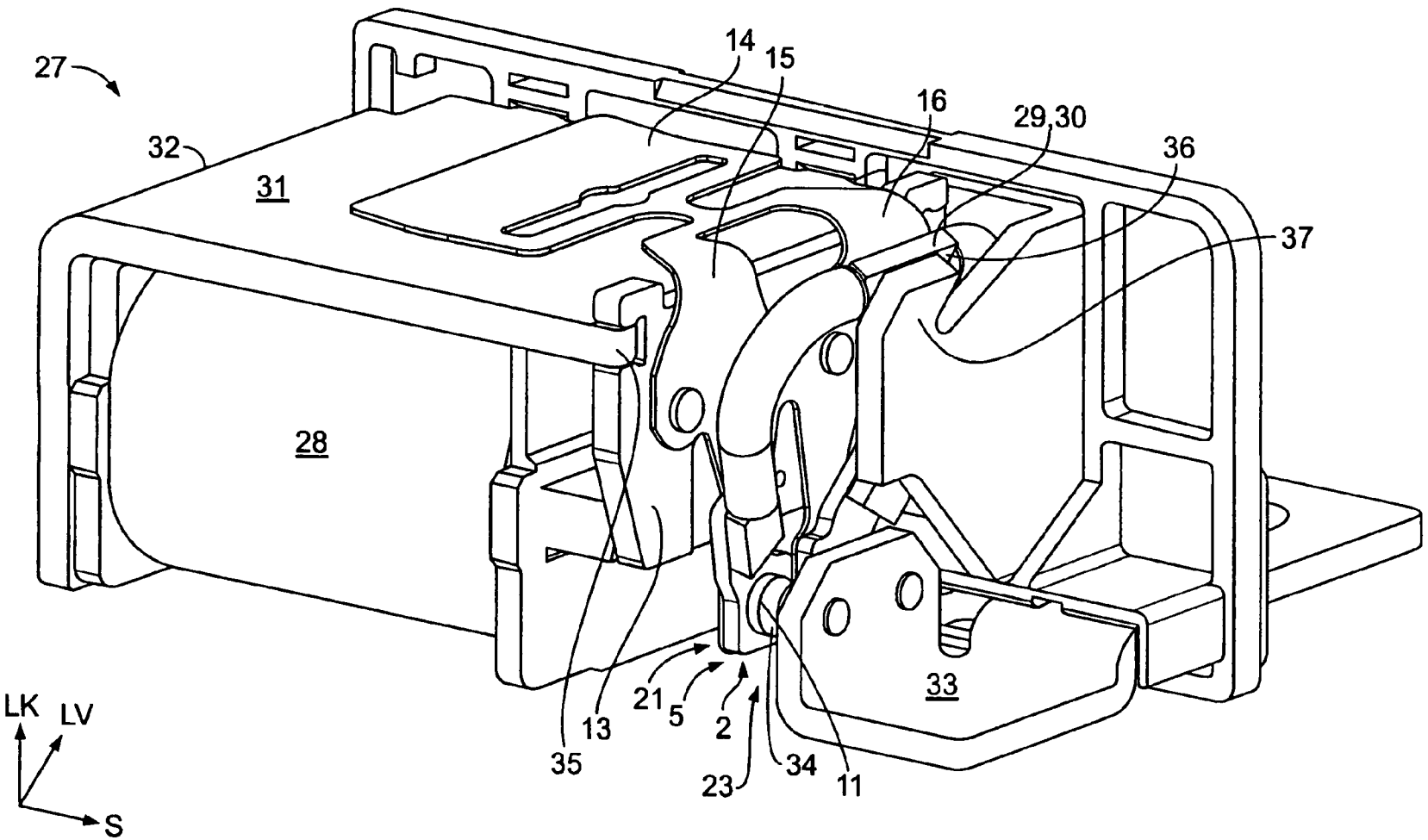
FIG. 4 is a perspective view of a third embodiment of the invention, in which the contact assembly is installed in a relay.

FIG. 4 shows a further embodiment, wherein identical reference numerals are used for components that correspond in operation and structure to those in the embodiments shown in the figures above. For the sake of brevity, only the differences from the embodiments in FIGS. 1 to 3 will be discussed.

In FIG. 4, the contact assembly 1 is shown installed in a relay 27. The relay 27 contains an actuator 28 in the form of a coil, which converts control signals into movements of the armature 13. The armature 13 passes on these movements to the switching arm 15 of the armature spring 12 and, in particular, to its free end 21 and to the switch contact 2, which is permanently connected thereto. Therefore, when an appropriate control signal is present at the relay 27, the switch contact 2 is deflected parallel to the switching direction S.

The contact assembly 1 is here equipped with two switch contacts 2, each of which is fastened to a free end 21 of two switching arms 15 via a connection element 5 in each case. Each connection element 5 is equipped with a connection strap 7, wherein the connection straps 7 essentially face in the direction of the switching axis A, or in the direction of two retaining grooves 24 provided laterally on the armature 13 in the region of the switching axis A. The two braid ends 3 which are fastened to the connection straps 7 continue in a straight line, facing away from one another in the braid 4, which, in this view, is equipped with two braid arcs 26, which run in a curved manner towards one another and graduate into one another in an essentially straight-line terminal region 29 disposed between the braid arcs 26. The terminal region 29, like the braid ends 3, takes the form of a rigid element 30.

The bend region 16 of the armature spring 12 encloses the opening 25, which exhibits a width, measured along the switching axis A, that is at least as great as the width of the rigid element 30 measured parallel with this acceptance width.

The bearing arm 14 bears with spring deflection on a stop 31 of an essentially L-shaped yoke 32 and introduces the spring force generated by this deflection via the bend portion 16 and the switching arm 15 into the armature 13. The switch contacts 2 with their switching surfaces 11, which run perpendicularly relative to the switching direction S, bear conductively on fixed contacts 34 mounted on a fixed-contact mounting 33 and are pressed against the fixed contacts 34 by the spring force of the prestressed armature spring 12. Alternatively, the relay 27, shown as a break relay, may also be configured as a make relay, in which the armature spring 12 pushes the switch contacts 2 away from the mating contacts 34. If the switch contacts 2 are each equipped with a plurality of switching surfaces 11, 23, which, where possible, face in and away from the switching direction S, and if the relay 27 provides a corresponding number of suitably aligned fixed contacts 34, the relay 27 may also take the form of a change-over relay.

The yoke 32 is equipped with retaining lugs 35, which engage in the retaining grooves 24 and secure the armature 3 against movements transversely relative to the switching direction S.

The rigid element 30 of the terminal region 29 is equipped with a connection surface 36 facing essentially in the switching direction S, which connection surface is automatically positioned in front of a fixed terminal 37 in a mounting position in switching direction S by means of the inclination of the connection straps 7. The positioning of the terminal region 29 may be further improved if the braid 4 is kept dimensionally stable as a self-supporting structure by its configuration.

The fixed terminal 37 takes the form of a continuation of a fixed-terminal mounting 38, extending essentially in a vertical direction H of the relay 27 running parallel with the longitudinal direction LK, which continuation is inclined in the switching direction S and runs parallel with the longitudinal direction LV. The fixed-terminal mounting 38 extends in a transverse direction Q of the relay 27 running transversely relative to the switching direction, and is aligned in parallel with the vertical direction H. In a bend region 39, which runs parallel with the vertical direction H, the fixed-terminal mounting 38 is shown angled away from the switching direction S.

The invention claimed is:

1. Contact assembly for a relay for switching high load currents, having at least one switching arm and at least one switch contact, at least one electrically conductive connection element equipped with a contact portion coupled to the switching arm and directly electrically conductively connected to the switch contact and having a flexible, conductive braid, which is electrically conductively connected to a connection strap of the connection element facing away from the contact portion, wherein the connection strap is inclined relative to the contact portion and the switching arm, wherein the contact assembly contains an armature pivotally mounted about a switching axis and an armature spring forming an angle, configured with a bearing arm and the switching arm, which switching arm is disposed between the armature and the contact portion and runs parallel with the armature, wherein the armature, bearing against an internal side of the switching arm, the switching arm and the contact portion are connected together, wherein the connection strap, inclined away from the armature, runs essentially in the direction of the switching axis.

2. Contact assembly according to claim 1, wherein the bearing arm and the switching arm graduate into one another in an arc-shaped, spring-energy-transmitting bend portion of the armature spring and that the bend portion and the switching axis run essentially in parallel with one another and are located in the same region.

3. Contact assembly according to claim 1, wherein the connection strap is aligned obliquely relative to the switching arm of the armature spring, and the braid is fastened to a connection surface of the connection strap that faces away from the switching arm of the armature spring.

4. Contact assembly according to claim 1, wherein the contact portion of the connection element is fastened, via the switch contact, to bear on the switching arm of the armature spring at a free end of the switching arm of the armature spring.

5. Contact assembly according to claim 1, wherein the contact portion and the switching arm are riveted via the switch contact.

* * * * *